US006532726B2

(12) United States Patent
Norster et al.

(10) Patent No.: US 6,532,726 B2
(45) **Date of Patent: *Mar. 18, 2003**

(54) GAS-TURBINE ENGINE COMBUSTION SYSTEM

(75) Inventors: Eric Roy Norster, Notts (GB); Simon DePietro, Lincoln (GB); Mahmoud Kowkabi, Lincoln (GB); Hoger Gunter Heinrich Hesse, Lincoln (GB)

(73) Assignee: Alstom Gas Turbines, Ltd., Lincoln (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/240,245

(22) Filed: Jan. 29, 1999

(65) Prior Publication Data

US 2001/0027637 A1 Oct. 11, 2001

(30) Foreign Application Priority Data

Jan. 31, 1998 (GB) ..... 9802021

(51) Int. Cl.[7] ..... F02C 9/00

(52) U.S. Cl. ..... 60/39.281; 60/737; 60/746; 60/742; 60/748; 60/39.463

(58) Field of Search ..... 60/39.281, 39.27, 60/748, 39.463, 737, 750, 39.141, 39.828, 742, 746

(56) References Cited

U.S. PATENT DOCUMENTS

| | | | | |
|---|---|---|---|---|
| 4,589,260 A | | 5/1986 | Krockow | |
| 5,311,742 A | * | 5/1994 | Izumi et al. | 60/742 |
| 5,359,847 A | * | 11/1994 | Pillsbury et al. | 60/39.06 |
| 5,404,711 A | * | 4/1995 | Rajput | 60/39.463 |
| 5,450,724 A | | 9/1995 | Kesseli et al. | |

FOREIGN PATENT DOCUMENTS

| | | | |
|---|---|---|---|
| EP | 0 071 420 A1 | | 2/1983 |
| EP | 0 108 361 A1 | | 5/1984 |
| EP | 0 728 989 A2 | | 8/1996 |
| GB | 217993 A | * | 6/1985 |
| GB | 2 175 993 A | | 12/1986 |
| GB | 2175993 A | * | 12/1986 |

* cited by examiner

*Primary Examiner*—Charles G. Freay
*Assistant Examiner*—William Rodriguez
(74) *Attorney, Agent, or Firm*—Kirschstein, et al.

(57) ABSTRACT

A gas-turbine engine combustion system has a combustor with a burner head having both pilot gas and pilot liquid-fuel injection arrangements, the pilot gas arrangement comprising an annular gallery communicating with a downstream face of the head and a deflecting arrangement adjacent the gallery for directing the pilot gas-fuel towards a longitudinal axis of the combustor and over a central part of the downstream face. The combustion system is designed so that, during both gas- and liquid-fuel operations, the flame front face is located close to the burner head and, during liquid-fuel operation, air is forced across the downstream face to cool the head. Advantageously, the cooling air is made to replace the pilot gas-fuel in the annular gallery, so that it is deflected, like the gas-fuel, and contacts the central part of the downstream face. The burner head also features main gas and liquid-fuel injection arrangements, these communicating with one or more passageways in a radial swirler attached to the head.

21 Claims, 4 Drawing Sheets

GAS-TURBINE ENGINE COMBUSTION SYSTEM

BACKGROUND OF THE INVENTION

The invention relates to a gas-turbine engine combustor capable of burning both gas and liquid fuels and in particular, but not exclusively, a combustor operating under a lean-burn combustion process.

Lean-burn combustor designs, in which very little if any combustion air is introduced into the combustor downstream of the location of the burner air-fuel mixing arrangement, are currently prevalent. The great advantage of lean-burn systems is the reduction of the levels of harmful emissions under high engine-load conditions. A drawback, however, is the difficulty that is experienced in maintaining the integrity of the combustor flame during low-load conditions, so that "flame-out", i.e., the simple extinction of the flame, does not occur.

To avoid flame-out at low engine-load conditions, prior-art designs have used techniques such as fuel-rich pilot-flame systems and staged fuel systems. The former are inclined to increase emission levels and the latter generally result in a complicated and expensive design.

SUMMARY OF THE INVENTION

The present invention aims to combine a reduction in harmful emissions with a reduction in complexity and consequently cost.

In its broadest aspect, the present invention provides a gas-turbine engine combustion system of the lean-burn type, having a combustor comprising a burner, a combustion pre-chamber and a combustion main chamber disposed in flow series, the burner comprising a burner head having a burner face including fuel injection means for the injection of fuel from the burner face into the pre-chamber, the combustor being arranged such that during operation of the combustor, a front face of a combustion flame burns closely adjacent the burner face, the burner further comprising fuel directing means for directing fuel towards the burner face during a first mode of operation of the combustor, and cooling air directing means for directing a flow of cooling air towards the burner face during a second mode of operation of the combustor.

According to a preferred embodiment of the present invention, a gas-turbine engine combustion system of the lean-burn type has a combustor comprising a burner, a combustion pre-chamber and a combustion main chamber disposed in flow series, the burner comprising a burner head, a burner face of the burner head, the burner face defining an upsteam extremity of the pre-chamber, gas fuel injection means for the injection of gas-fuel from the burner head into the pre-chamber, and liquid-fuel injection means separate from the gas-fuel injection means for the injection of liquid-fuel from the burner head into the pre-chamber, the combustor being arranged such that during operation of the combustor a front face of a combustion flame burns closely adjacent a central part of the burner face, the combustion system further having means for enabling changeover from gas fuel operation of the combustor to liquid fuel operation of the combustor, and means operable during liquid-fuel operation of the combustor to prevent injection of gas fuel and enable injection of cooling air from the burner head into the prechamber, the burner further comprising directing means, whereby gas-fuel is directed towards the central part of the burner face during gas-fuel operation of the combustor and cooling air is directed towards the central part of the burner face during liquid-fuel operation of the combustor.

It is convenient, but not essential, that the same directing means be utilized to direct both the gas fuel and the cooling air towards the central part of the burner face.

The gas-fuel injection means may include duct means adapted to inject the gas-fuel and the cooling air in an annular configuration towards the central part of the burner face.

The directing means may comprise lip means provided on the burner face and extending towards the central part of the burner face, the lip means being disposed relative to the injector means such as to deflect gas-fuel and air exiting the injector means towards the central part of the burner face.

The liquid-fuel injection means may be disposed between the gas-fuel injection means and the central part of the burner face. Preferably, the liquid-fuel injection means comprises a liquid-fuel duct means communicating with the burner face. An igniter may be disposed between the gas-fuel injection means and the liquid-fuel injection means, or between adjacent liquid-fuel injection means.

The liquid-fuel and gas-fuel injection means preferably comprise pilot gas-fuel injection means, pilot liquid-fuel injection means, main gas-fuel injection means and main liquid-fuel injection means, all the pilot and main fuel injection means being in communication with the burner face. Advantageously, the main liquid-fuel injection means is disposed radially outwards of the pilot gas-fuel injection means. The main gas-fuel injection means may be disposed radially outwards of the main liquid-fuel injection means.

The burner preferably includes a radial swirler disposed between the burner face and the pre-chamber, the swirler having a plurality of passages for the flow of combustion air through the swirler towards the central part of the burner face. Preferably, the main gas-fuel injection means communicates with at least one of the swirler passages adjacent a radially outer part of the passages, while the main liquid-fuel injection means communicates with at least one of the passages adjacent a radially inner part of the passages.

The combustion system includes fuel-inlet means communicating with the pilot and main gas-fuel and liquid-fuel injection means for the supply of fuel thereto, a control means being connected to the fuel-inlet means for controlling the flow of fuel into the pilot and main gas-fuel and liquid-fuel injection means such that during liquid-fuel operation, the control means diverts pilot gas-fuel away from the pilot gas-fuel injection means and connects to the latter a source of the cooling air.

The invention further provides a method of operating the above combustion system during a gas-fuel operation of the combustor, comprising the steps of:

initiating injection of pilot fuel and main fuel into the pre-chamber at predetermined respective mass flow rates, and varying the respective mass flow rates of the injected pilot fuel and main fuel relative to a total gas-fuel mass flow rate between a start-up condition and a full-load condition of the engine, such that at the start-up condition of the engine, the total gas-fuel flow predominantly comprises pilot fuel and, at the full-load condition of the engine, the total gas-fuel flow predominantly comprises main fuel.

Preferably, at the start-up condition of the engine, the main gas-fuel provides not more than about 5% of total gas fuel flow, and the pilot gas-fuel provides not less than about 95% of total gas fuel flow, whereas at the full-load condition of the engine, the main gas-fuel provides not less than about 95% of total gas fuel flow, and the pilot gas-fuel provides not more than about 5% of total gas fuel flow, but more than 0% thereof.

The invention further provides a method of operating the above combustion system during a liquid-fuel operation of the combustor, comprising the steps of:

initiating injection of pilot liquid fuel into the pre-chamber at a predetermined mass flow rate during a start-up condition of the engine, increasing the mass flow rate of pilot liquid fuel to increase engine power towards a full load condition of the engine, initiating injection of main liquid fuel into the pre-chamber at a predetermined mass flow rate when a predetermined fraction of the full-load condition of the engine is attained, continuously decreasing the supply of pilot fuel and increasing the supply of main fuel until the full-load condition of the engine is attained, and injecting cooling air into the prechamber from the burner head using the directing means during said liquid-fuel operation of the combustor.

The above predetermined fraction of the full-load condition of the engine may be approximately 70% and at the full-load condition of the engine the main liquid fuel may provide not less than about 95% of total liquid fuel flow and the pilot liquid fuel may provide not more than about 5% of total liquid fuel flow, but more than 0% thereof.

BRIEF DESCRIPTION OF THE DRAWINGS

An embodiment of the invention will now be described with reference to the accompanying drawings, in which.

DETAILED DESCRIPTION OF THE PREFERRED EMBODIMENTS

Figure 1:
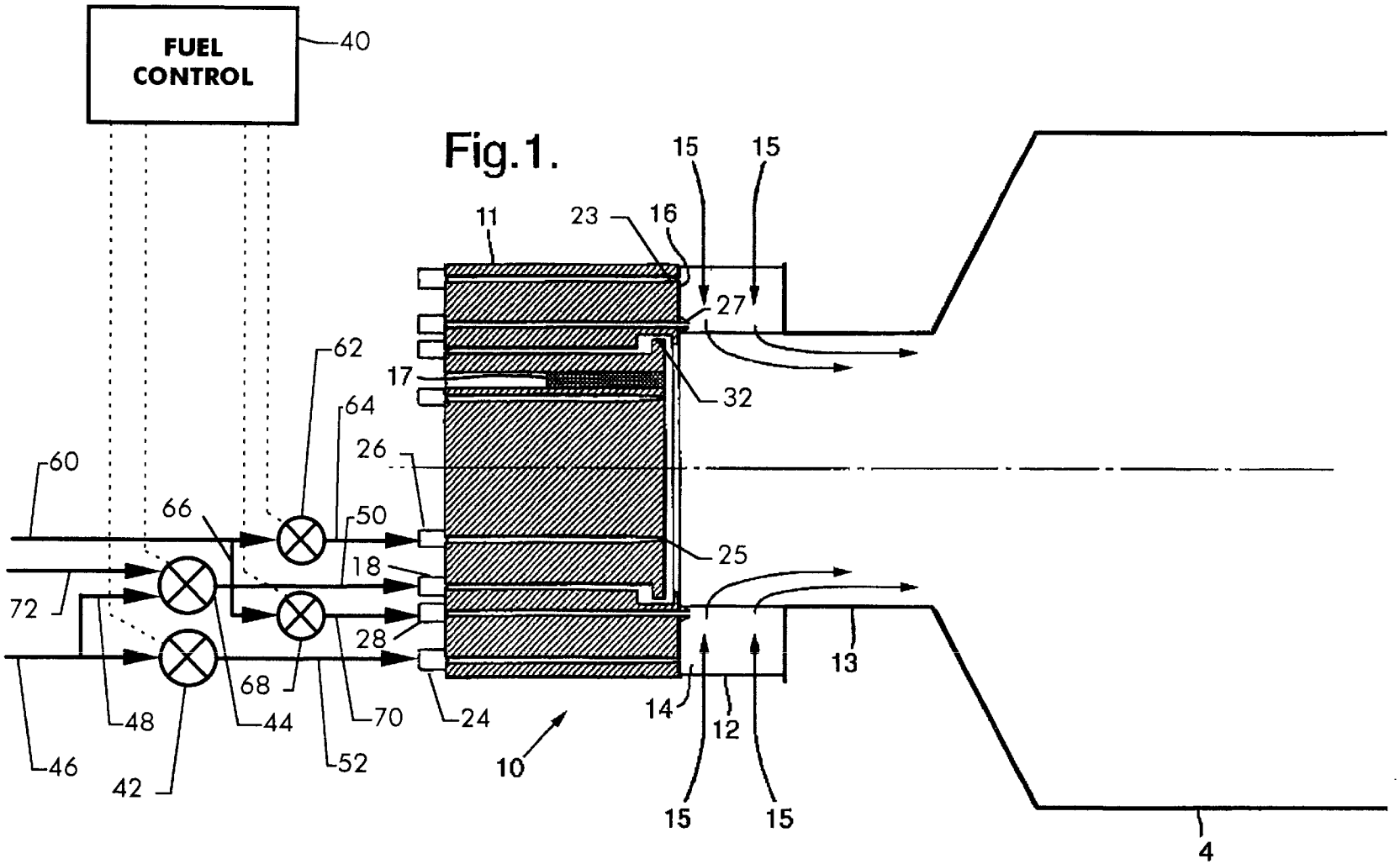
FIG. 1 schematically illustrates a combustion system according to the invention and includes a simplified axially sectioned view of a combustor forming part of the combustion system.

Referring now to FIG. 1, a longitudinal section of a combustor according to the invention is illustrated, consisting of a burner 10, comprising a burner-head portion 11 attached to a radial-inflow swirler portion 12, a combustion pre-chamber 13 and a main combustion chamber 14. The main chamber has a diameter larger than that of the pre-chamber. The swirler 12 has a number of spaced-apart vanes 30 (see FIG. 4) which define passages 14 therebetween.

In operation, compressed air 15, flowing in the direction of the arrows shown, is supplied to the burner (usually from the gas-turbine compressor) and moves through the passages 14 between the swirler vanes. The air mixes with fuel injected from the downstream burner-head face 16 and, on arriving in the pre-chamber 13, the mixture is ignited by means such as the electric igniter unit 17. Once lit, the flame continues to burn without further assistance from such igniter.

The gas-fuel and liquid-fuel modes of operation of the combustor will now be separately described.

The gas-fuel mode of operation will be described with reference to FIG. 1 and FIG. 2. The gas-fuel system comprises a pilot-fuel system and a main-fuel system which work together in a progressive manner to give a seamless change in operation from one to the other. When the engine is started, the fuel controller 40 controls variable valves 42 and 44 so that most of the gas-fuel from supply line 46 is directed to the pilot system, whereby gas supplied through connector 18 at the burner head 11 moves through passages in the head eventually arriving at an annular gallery 19 from where it is directed, via either a series of spaced-apart bores 32 or a continuous annular duct, to the underside of a directing means in the form of a circumferential lip 20 extending radially inwards towards the longitudinal axis 21 of the combustor. The lip 20 deflects the pilot gas across a central portion 22 of the face 16, i.e., radially inwards in a direction generally normal to the axis 21. The pilot gas mixes with incoming compressed air 15 and main gas-fuel exiting the swirler-vane passages 14 (the main gas-fuel exits the burner head at the openings 23), igniter 17 being then activated to start a pilot flame. The main gas-fuel jets 23 are located at the swirler air-inlet region, i.e., adjacent a radially outer part of the passages 14, and are fed from connectors 24 through interconnecting ducts, as shown.

At starting of the engine and at low load, the great majority (for example, 95%) of the fuel injected is pilot gas-fuel passing through path 46, 48, 50 by way of valve 44, leaving the balance to be supplied by the main gas injectors 23 by way of valve 42, which at this stage is just cracked open. However, as engine load and speed increase, the valve 44 is progressively closed and simultaneously therewith the valve 42 is progressively opened, thereby increasing the main gas supply to the connectors 24 through path 46, 52 so that progressively a greater proportion of the total mass flow of gas fuel in line 46 is injected into the prechamber from main jets 23. The main gas and air mix together as they pass inwardly through the swirler passages 14 on their way to the combustion flame within the pre-chamber 13 and main chamber 14. As load further increases, the fuel control 40 continues to progressively change the settings of valves 42, 44 so that progressively more fuel is introduced through the main gas connector 24 and less through the pilot connector 18, whereby eventually at full load approximately 95% of the total fuel requirement is met via the main connector 24 and the rest via the pilot connector 18.

However valve 44 is never set to close off path 46, 48, 50 completely, so that there is always some flow of gas from the pilot system across the burner's center face 22.

Figure 2:
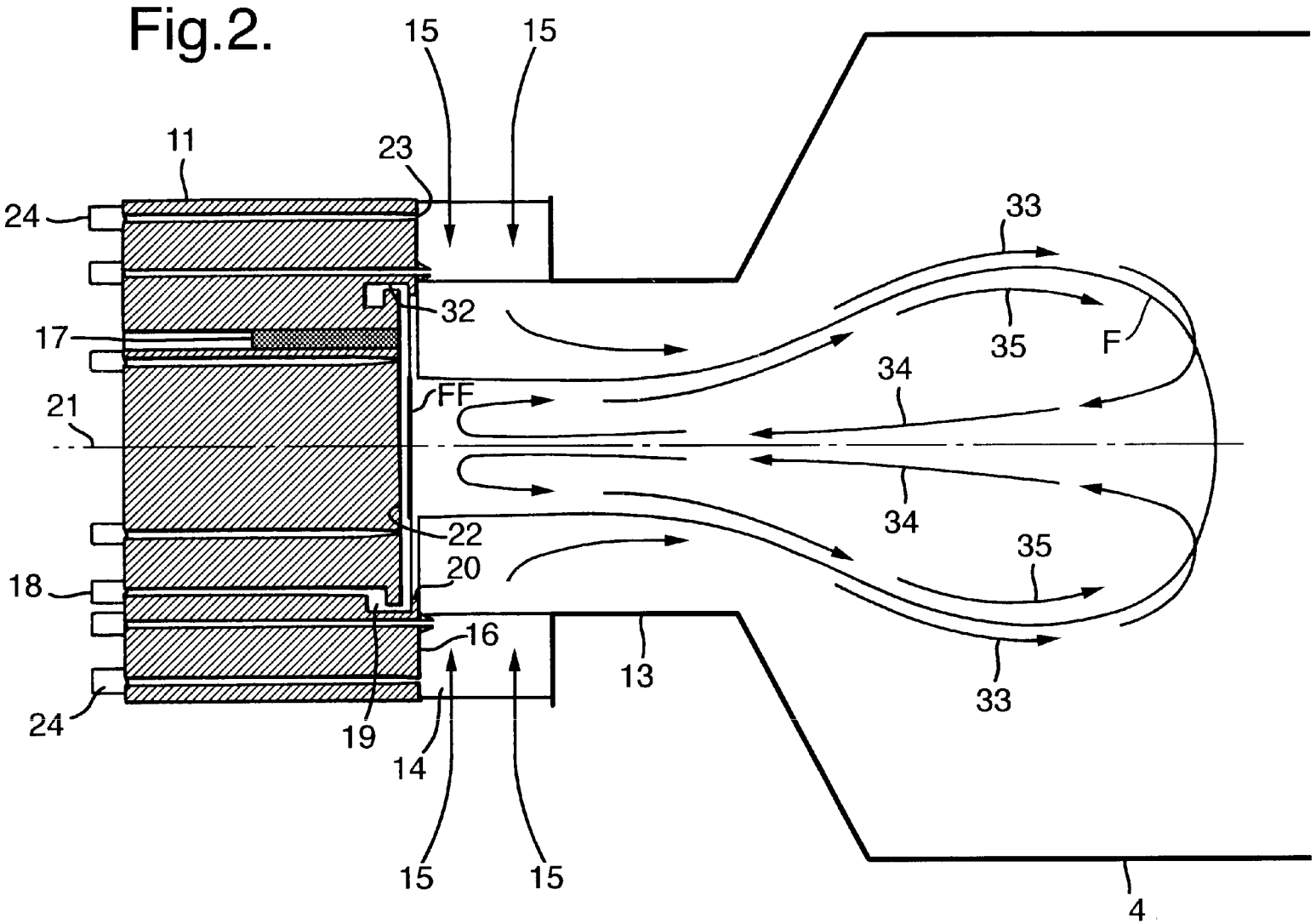
FIG. 2 is the combustor of FIG. 1 operating in gas-fuel mode.

FIG. 2 shows a combustion-flame envelope represented by the boundary line "F" and flame front face "FF". The flame front FF is created by the recirculation of fluid 33 entering the combustion chamber along the radially outer parts of the chamber back along the central axial part of the chamber (axis 21) towards the burner (see arrows 34) and then back again towards the main chamber (see arrows 35), the front face FF itself being the point at which the axial flow 34 in the direction of the burner turns back on itself (35).

It is a feature of the present burner that at all engine load settings the flame front remains adjacent the face 22. (It should be noted that in known pre-chamber/main-chamber combustion systems it is conventional for the flame front of the main flame, though not necessarily the pilot flame, to be positioned not so far upstream in the pre-chamber.)

The present invention causes the front face FF to reach near to the burner face 22 by, for example, employing a high ratio of pre-chamber diameter to length (in a working example this ratio was 2:1); and by dispensing with axially issuing air or fuel jets which conventionally might be provided at the central region of the face 22, such jets acting against the flow 34 to limit progress of the flame face toward the burner face 22.

It could be supposed that having a flame front adjacent the face 22 would ordinarily cause overheating and damage to that face, and hence lead to problems of reliability. However, the curtain of pilot gas washing across the face 22 provides an effective insulation to prevent such damage. This design of the burner, whereby the front face of the flame is always maintained adjacent the downstream face 22 of the burner head, and therefore within the pre-chamber, is advantageous in the sense that the air-fuel mixture within the pre-chamber has sufficient velocity to prevent ignition flash-back into the swirler; this is due to the relatively small cross-sectional area of the pre-chamber 13 in relation to the mass flow rate of fuel and air passing through it.

Turning now to the liquid-fuel mode of the present combustor (see FIGS. 1 and 3), this mode of operation employs, as with the gas-mode, both pilot- and main-fuel systems controlled through variable valves 62 and 68 and the flame front in this mode is also situated adjacent the burner face 22 at all load settings.

At least one, but preferably several, liquid-fuel pilot jets 25, located at the periphery of the central part 22 of the burner face 16, are provided and are fed liquid fuel for pilot-flame operation from line 60 by way of valve 62, line 64, connection(s) 26 and appropriate ducts in the burner head. Such pilot jets 25 are positioned in the burner face outside the outer circumference of the combustion flame adjacent the face 22. Main liquid-fuel jets 27 are also fed from line 60 by way of line 66, valve 68, line 70, fuel connectors 28 and suitable passageways in the burner head. Jets 27 are situated in the burner face 16 at or near the air-exit region of the swirler 12, i.e., near a radially inner portion of the swirler passages 14.

When the engine is started, liquid pilot fuel is injected from pilot jets 25 into the pre-chamber 13 in an axial direction parallel, or approximately parallel, to the central longitudinal axis 21, where it mixes with air 15 exiting the swirler passages 14, the air-fuel mixture being ignited by a spark from the igniter unit 17. On start-up fuel control 40 controls valves 62, 68 so that valve 68 is shut and all the fuel requirement is met by the pilot jet(s) 25, the main fuel jets 27 playing no part at this stage.

As engine load increases from start-up to approximately 70% full load, valve 62 is controlled so that a progressively greater proportion of the total liquid fuel mass flow rate in line 60 is fed through the pilot jet(s) 25 until at approximately 70% full load there occurs a change in the fuel scheduling whereby valve 68 is opened and main fuel is introduced from jets 27. The main fuel supply then takes over to provide approximately 95% of the total engine fuel requirement between 70% and 100% of full load, so that in that load range about 5% only is supplied from the pilot jet(s) 25. It is significant that the valve 62 is kept at least slightly open so that there is at all times some pilot fuel flow, even at full-load conditions.

The main liquid-fuel jets 27 are located on the burner face 16 in the air-exit region of the swirler passages 14 and inject fuel in a direction approximately perpendicular to the air-stream flow 15. It is important that all the liquid-fuel injected should be carried into the airstream and none be allowed to contact the upstream/downstream sidewalls of the swirler 12, or the vane walls, to the extent that a wall becomes wetted. To this end, the fuel jet bodies are positioned proud of the mounting surface 16 with the jet orifices distant from the surface so that at low fuel-pressure settings the fuel does not dribble onto the surface. For similar reasons, when operating at higher fuel-pressure settings, the pressure is controlled so that it is not sufficient to force the fuel into contact with a downstream passage wall 29 of the swirler.

Importantly, while operating on liquid fuel and to avoid overheating of, and consequent damage to, the face 22, air under pressure from line 72 is routed through multi-position variable valve 44 and line 50 to the pilot-gas injector to wash over the face 22 in the same manner that pilot gas is brought into contact with the face during gas operation. Such air functions as a coolant and an insulating barrier to protect the face 22 from the heat of the flame.

Figure 3:
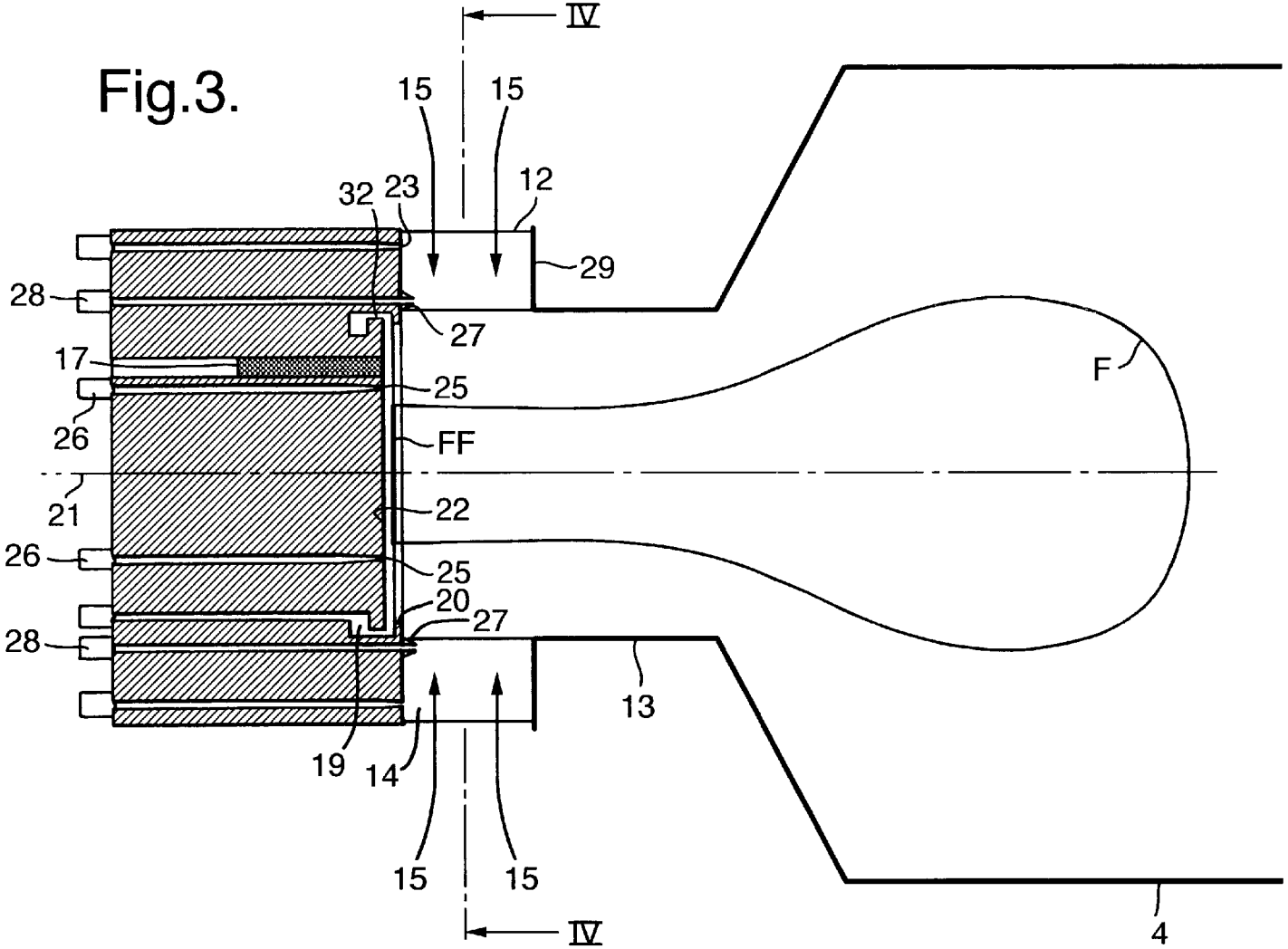
FIG. 3 is the combustor of FIG. 1 operating in liquid-fuel mode.
Figure 4:
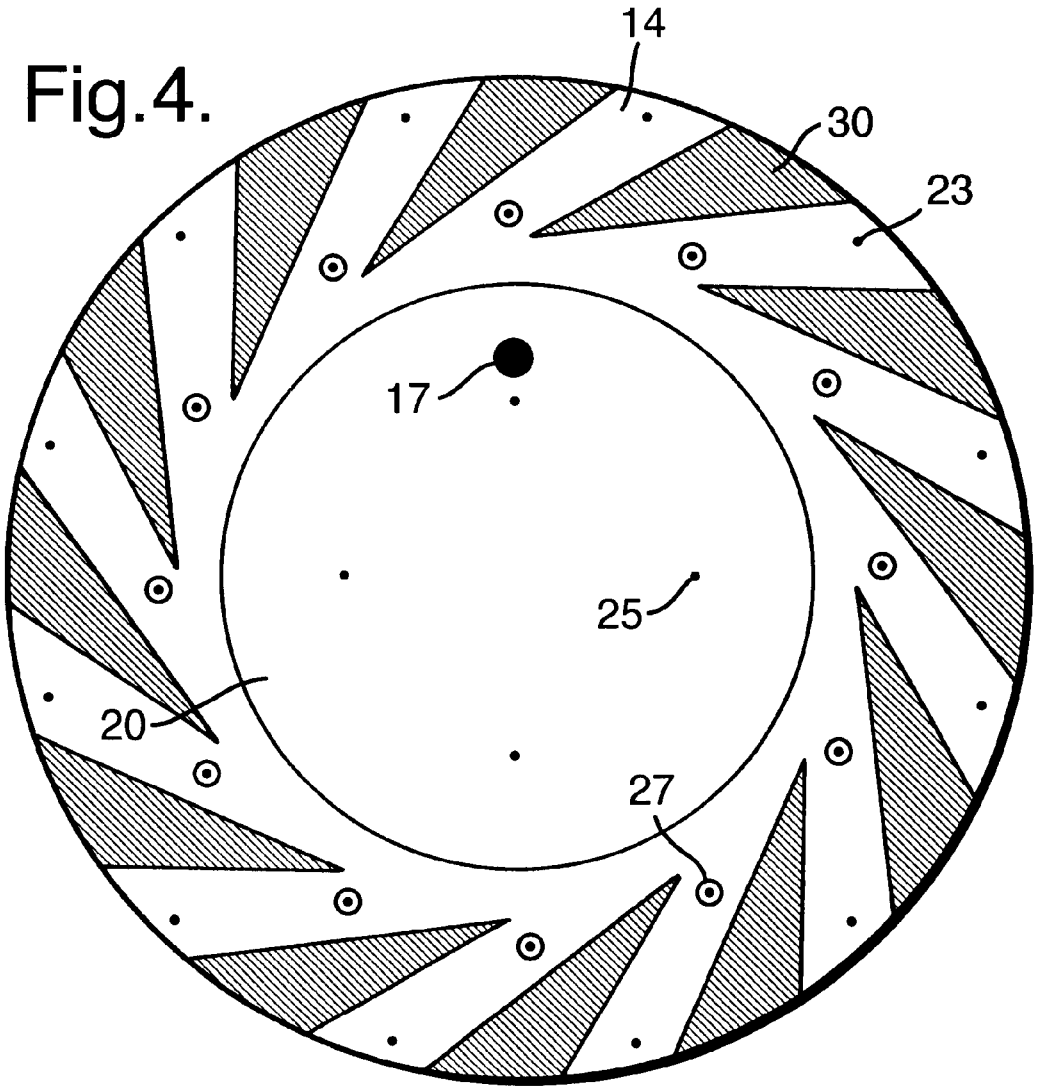
FIG. 4 is a transverse section IV—IV through the burner of FIG. 3.

FIG. 4 is a section taken on line "IV—IV" through FIG. 3 and illustrates the configuration of the swirler vanes and passages and the disposition of the gas and liquid fuel jets as employed in the embodiment of the invention described above. The hatched triangular areas 30 are the vane sections, while the clear areas between the vanes are the air passageways 14.

While the preferred method of conveying cooling air to the downstream face of the burner head is to employ the pilot gas ducts themselves to carry the air, an alternative scheme is to use dedicated outlets (not shown) in the head, situated, for example, between the spaced-apart gas outlets 32. These dedicated outlets will be fed from similarly dedicated passageways (also not shown) supplied from suitable inlets and a separate valve controlled by fuel control 40.

Also, although the igniter 17 has been represented as being located at a radius between that of the pilot liquid-fuel jets 25 and that of the annular gallery 19, it may alternatively be at the same radius as the jets 25.

We claim:

1. A gas-turbine engine combustion system of the lean-burn type, comprising:

a) a combustor including a burner;

b) a combustion pre-chamber;

c) a combustion main chamber disposed in flow series along a longitudinal axis;

d) the burner including:

i) a burner head, ii) a burner face of the burner head, the burner face defining an upstream extremity of the pre-chamber, iii) a radial swirler disposed between the burner face and the pre-chamber, iv) gas-fuel injection means for injecting gas-fuel from the burner head into the pre-chamber, and v) liquid-fuel injection means separate from the gas-fuel injection means for injecting liquid-fuel from the burner head into the pre-chamber;

e) the swirler having a plurality of passages for the flow of combustion air through the swirler towards a central part of the burner face;

f) the combustion system comprising:

an arrangement for enabling changeover from gas-fuel operation of the combustor to liquid-fuel operation of the combustor, and operable during the liquid-fuel operation of the combustor to prevent injection of the gas-fuel and enable injection of cooling air from the burner head into the prechamber; and g) the burner further including directing means for direction the gas-fuel towards the central part of the burner face during the gas-fuel operation of the combustor, and for directing the cooling air towards the central part of the burner face during the liquid-fuel operation of the combustor.

2. The combustion system as claimed in claim 1, wherein the directing means is a single deflector to direct both the gas-fuel and the cooling air towards the central part of the burner face.

3. The combustion system as claimed in claim 1, wherein the gas-fuel injection means includes duct means for injecting the gas-fuel and the cooling air in an annular configuration towards the central part of the burner face.

4. The combustion system as claimed in claim 1, wherein the directing means comprises a lip provided on the burner face and extending towards the central part of the burner face, the lip being disposed relative to the injection means to deflect the gas-fuel and the air exiting the injection means towards the central part of the burner face.

5. The combustion system as claimed in claim 1, wherein the liquid-fuel injection means is disposed between the gas-fuel injection means and the central part of the burner face.

6. The combustion system as claimed in claim 1, wherein the liquid-fuel injection means comprises a liquid-fuel duct means communicating with the burner face.

7. The combustion system as claimed in claim 1, including an igniter disposed between the gas-fuel injection means and the liquid-fuel injection means.

8. The combustion system as claimed in claim 1, including an igniter disposed between adjacent liquid-fuel injection means.

9. The combustion system as claimed in claim 1, wherein the liquid-fuel and gas-fuel injection means comprise first pilot gas-fuel injection means, first pilot liquid-fuel injection means, second main gas-fuel injection means and second main liquid-fuel injection means, all said fuel injection means being in communication with the burner face.

10. The combustion system as claimed in claim 9, wherein the second main liquid-fuel injection means is disposed radially outwards of the first pilot gas-fuel injection means relative to the axis.

11. The combustion system as claimed in claim 10, wherein the second main gas-fuel injection means is disposed radially outwards of the second main liquid-fuel injection means relative to the axis.

12. The combustion system as claimed in claim 9, wherein the second main gas-fuel injection means communicates with at least one of the swirler passages adjacent a radially outer part of the passage relative to the axis, and the second main liquid-fuel injection means communicates with at least one of the passages adjacent a radially inner part of the passages relative to the axis.

13. The combustion system as claimed in claim 1, including fuel-inlet means communicating with the gas-fuel and liquid-fuel injection means for the supply of fuel thereto, a control means being connected to the fuel-inlet means for controlling the flow of fuel into the gas-fuel and liquid-fuel injection means such that, during liquid-fuel operation, the control means diverts the gas-fuel away from the gas-fuel injection means and connects to the latter a source of the cooling air.

14. The combustion system as claimed in claim 9, including fuel-inlet means communicating with the first pilot and second main gas-fuel and liquid-fuel injection means for the supply of fuel thereto, a control means being connected to the fuel-inlet means for controlling the flow of fuel into the first pilot and second main gas-fuel and liquid-fuel injection means such that, during liquid-fuel operation, the control means diverts pilot gas-fuel away from the first pilot gas-fuel injection means and connects to the latter a source of the cooling air.

15. A gas-turbine engine combustion system of the lean-burn type, comprising:

a) a combustor including a burner;

b) a combustion pre-chamber;

c) a combustion main chamber disposed in flow series along a longitudinal axis;

d) the burner including:

i) a burner head, ii) a burner face of the burner head, the burner face defining an upstream extremity of the pre-chamber, iii) a radial swirler disposed between the burner face and the pre-chamber, iv) gas-fuel injection means for injecting gas-fuel from the burner head into the pre-chamber, and v) liquid-fuel injection means separate from the gas-fuel injection means for injecting liquid-fuel from the burner head into the pre-chamber;

e) the combustor being arranged such that, during operation of the combustor, a front face of a combustion flame burns closely adjacent a central part of the burner face;

f) the combustion system comprising: an arrangement for enabling changeover from gas-fuel operation of the combustor to liquid-fuel operation of the combustor, and operable during the liquid-fuel operation of the combustor to prevent injection of the gas-fuel and enable injection of cooling air from the burner head into the pre-chamber;

g) the burner further including directing means for directing the gas-fuel towards the central part of the burner face during the gas-fuel operation of the combustor, and for directing the cooling air towards the central part of the burner face during the liquid-fuel operation of the combustor;

h) the liquid-fuel and gas-fuel injection means comprising first pilot gas-fuel injection means, first pilot liquid-fuel injection means, second main gas-fuel injection means and second main liquid-fuel injection means, all said fuel injection means being in communication with the burner face; and i) the swirler having a plurality of passages for the flow of combustion air through the swirler towards the central part of the burner face, the second main gas-fuel injection means communicating with at least one of the swirler passages adjacent a radially outer part of the passages relative to the axis, and the second main liquid-fuel injection means communicating with at least one of the passages adjacent a radially inner part of the passages relative to the axis.

16. A gas-turbine engine combustion system of the lean-burn type, comprising:

a) a combustor including a burner;

b) a combustion pre-chamber;

c) a combustion main chamber disposed in flow series;

d) the burner including:

i) a burner head, ii) a burner face of the burner head, the burner face defining an upstream extremity of the pre-chamber, iii) gas-fuel injection means for injecting gas-fuel from the burner head into the pre-chamber, and iv) liquid-fuel injection means separate from the gas-fuel injection means for injecting liquid-fuel from the burner head into the pre-chamber;

e) the combustor being arranged such that, during operation of the combustor, a front face of a combustion flame burns closely adjacent a central part of the burner face;

f) the combustion system comprising: an arrangement for enabling changeover from gas-fuel operation of the combustor to liquid-fuel operation of the combustor, and operable during the liquid-fuel operation of the combustor to prevent injection of the gas-fuel and enable injection of cooling air from the burner head into the pre-chamber;

g) the burner further including directing means for directing the gas-fuel towards the central part of the burner face during the gas-fuel operation of the combustor, and for directing the cooling air towards the central part of the burner face during the liquid-fuel operation of the combustor;

h) fuel-inlet means communicating with the gas-fuel and liquid-fuel injection means for the supply of fuel thereto; and i) control means connected to the fuel-inlet means for controlling the flow of fuel into the gas-fuel and liquid-fuel injection means such that, during liquid-fuel operation, the control means diverts the gas-fuel away from the gas-fuel injection means and connects to the latter a source of the cooling air.

17. A gas-turbine engine combustion system of the lean-burn type, comprising:

a) a combustor including a burner;

b) a combustion pre-chamber;

c) a combustion main chamber disposed in flow series;

d) the burner including:

i) a burner head, ii) a burner face of the burner head, the burner face defining an upstream extremity of the pre-chamber, iii) gas-fuel injection means for injecting gas-fuel from the burner head into the pre-chamber, and iv) liquid-fuel injection means separate from the gas-fuel injection means for injecting liquid-fuel from the burner head into the pre-chamber;

e) the combustor being arranged such that, during operation of the combustor, a front face of a combustion flame burns closely adjacent a central part of the burner face;

f) the combustion system comprising: an arrangement for enabling changeover from gas-fuel operation of the combustor to liquid-fuel operation of the combustor, and operable during the liquid-fuel operation of the combustor to prevent injection of the gas-fuel and enable injection of cooling air from the burner head into the pre-chamber;

g) the burner further including directing means for directing the gas-fuel towards the central part of the burner face during the gas-fuel operation of the combustor, and for directing the cooling air towards the central part of the burner face during the liquid-fuel operation of the combustor;

h) the liquid-fuel and gas-fuel injection means comprising first pilot gas-fuel injection means, first pilot liquid-fuel injection means, second main gas-fuel injection means and second main liquid-fuel injection means, all said fuel injection means being in communication with the burner face;

i) fuel-inlet means communicating with the first pilot and second main gas-fuel and liquid-fuel injection means for the supply of fuel thereto; and j) control means connected to the fuel-inlet means for controlling the flow of the fuel into the first pilot and second main gas-fuel and liquid-fuel injection means such that, during liquid-fuel operation, the control means diverts pilot gas-fuel away from the first pilot gas-fuel injection means and connects to the latter a source of the cooling air.

18. A gas-turbine engine combustion system of the lean-burn type, comprising: a combustor including a burner, a combustion pre-chamber having a cross-sectional area, a combustion main chamber disposed in flow series and having a cross-sectional area larger than the cross-sectional area of the pre-chamber, and a transition region between the pre-chamber and the main chamber, the pre-chamber having a substantially constant cross-sectional area between the burner and the transition region, the burner including a burner head having a burner face including fuel injection means for injecting fuel from the burner face into the pre-chamber, the pre-chamber having a lengthwise extent between the burner face and the main chamber, the combustor being arranged such that, during operation of the combustor, a front face of a combustion flame burns closely adjacent the burner face, the burner further including fuel directing means for directing the fuel towards the burner face during a first mode of operation of the combustor, and cooling air directing means for directing a flow of cooling air towards the burner face during a second mode of operation of the combustor.

19. The combustion system as claimed in claim 18, including means for enabling changeover from a gas-fuel operation of the combustor in the first mode to a liquid-fuel operation of the combustor in the second mode, and means operative during the liquid-fuel operation of the combustor, for preventing injection of a gas-fuel, and for enabling injection of the cooling air from the burner head into the pre-chamber through the directing means.

20. The combustion system as claimed in claim 18, wherein the transition region has a cross-sectional area that increases in a direction from the pre-chamber to the main chamber.

21. The combustion system as claimed in claim 18, including combustion air injection means disposed downstream of the burner face for injecting combustion air into the pre-chamber.

* * * * *